United States Patent [19]

Masui

[11] Patent Number: 4,834,244

[45] Date of Patent: May 30, 1989

[54] DISPENSING CASE WITH RULED PERFORATED LINE

[76] Inventor: Toshimune Masui, No. 4-3, Ohgata 3-chome, Kashiwara-shi, Osaka, Japan

[21] Appl. No.: 176,175

[22] Filed: Mar. 31, 1988

[51] Int. Cl.[4] ..... B65D 17/28

[52] U.S. Cl. ..... 206/609; 206/612

[58] Field of Search ..... 206/608, 609, 611, 612, 206/628

[56] References Cited

U.S. PATENT DOCUMENTS

| | | | |
|---|---|---|---|
| 2,626,096 | 1/1953 | Hickin | 206/608 |
| 2,953,293 | 9/1960 | Anderson | 206/609 |
| 2,974,852 | 3/1961 | Huss et al. | 206/608 |
| 3,019,944 | 2/1962 | Nelson et al. | 206/628 |
| 3,209,941 | 10/1965 | Krake | 206/611 |

FOREIGN PATENT DOCUMENTS

| | | | |
|---|---|---|---|
| 862461 | 3/1961 | United Kingdom | 206/602 |

*Primary Examiner*—Stephen P. Garbe

*Attorney, Agent, or Firm*—Wenderoth, Lind & Ponack

[57] ABSTRACT

A packaging case formed of a boxboard and having annular perforations provided on a wall to enable an opening to be formed when a portion surrounded by the perforations is removed by cutting the perforations.

On the wall of the case on which the perforations are provided there is embossed a ruled line extending along the perforations in overlapping relation therewith, by which the strength of the portion of the boxboard in which the perforations are present is lowered so that as the perforations are cut in order to form the opening in the case, the force of tearing is guided by the ruled line along the perforations. By this arrangement the portion surrounded by the perforations can be accurately removed by a relatively small force of tearing and an opening defined by the perforations can be thus accurately formed without the path of the tearing action being allowed to deviate from the perforations.

2 Claims, 2 Drawing Sheets

DISPENSING CASE WITH RULED PERFORATED LINE

BACKGROUND OF THE INVENTION

The present invention relates to a case, and more specifically, to a boxboard-made case for use in packaging facial tissues or the like which is provided with an arrangement for forming an opening therein.

Conventional cases for packaging facial tissues, for example, are boxboard-made and have a rectangular box construction in which annular perforations are provided on a top wall of the box for forming an outlet opening through which tissues are to be drawn out one after another. Said opening is formed by removing a portion surrounded by the perforations by tearing it off along the perforations.

In such a case for facial tissues, a synthetic resin film is placed on the underside of the top wall and at a position corresponding to the opening, said film having a slit centrally formed therein which extends in the longitudinal direction of the opening so that when a tissue is drawn through the opening, it is subjected to some resistance, whereby one tissue only is allowed to be drawn out at one time, while a succeeding tissue is allowed to project partially from the opening.

However, the conventional cases have a drawback in that the perforations provided for forming an opening are merely such that small perforations are intermittently arranged on the top wall, so that the gap between each pair of adjacent perforations is as thick as the boxboard material. Hence when the portion surrounded by the perforations is torn off along the perforations in order to form the opening, there will occur some resistance at the gaps between the individual perforations.

Therefore, when breaking the perforations by pulling a cover plate portion, i.e., the portion surrounded by the perforations, in order to form the opening, it is difficult to guide the force of tearing from one perforation to another. Thus, the force of tearing may go astray from the direction of the perforations and no smooth tearing can be performed, causing, for example, the cover plate portion to be broken halfway so that tearing has to be done again with a remaining portion thereof, or the tearing to be directed outwardly of the opening so that the opening is formed in a very unsightly way.

It is a usual practice to perform tearing while applying a finger tip force along the perforations in order to facilitate smooth tearing. However, the trouble with this practice is that the cutting of the perforations under the thrust of a finger tip is not only time-consuming, but also it may result in cutting the film provided on the underside of the top wall or removing the bond between the underside of the top wall and the film, thereby adversely affecting the function of the film.

SUMMARY OF THE INVENTION

Accordingly, it is a first object of the invention to provide a case which allows a force of tearing to be smoothly directed along the perforations for formation of an outlet opening, thereby enabling accurate, easy and efficient formation of the opening.

It is a second object of the invention to provide a case which is free of the possibility of a cover plate portion being torn off halfway when a force of tearing is applied in order to form an opening, or free of such possibility that the path of the tearing action is caused to extend outwardly of the opening so that the opening is formed in an unsightly way.

It is a third object of the invention to provide a case which permits an opening to be accurately formed without the necessity of a finger tip force being applied along the perforations and which is free from the possibility of any damage or peel being caused to the film provided on the underside of the top wall in the course of the opening being formed.

DESCRIPTION OF THE PREFERRED EMBODIMENTS

Figure 1:
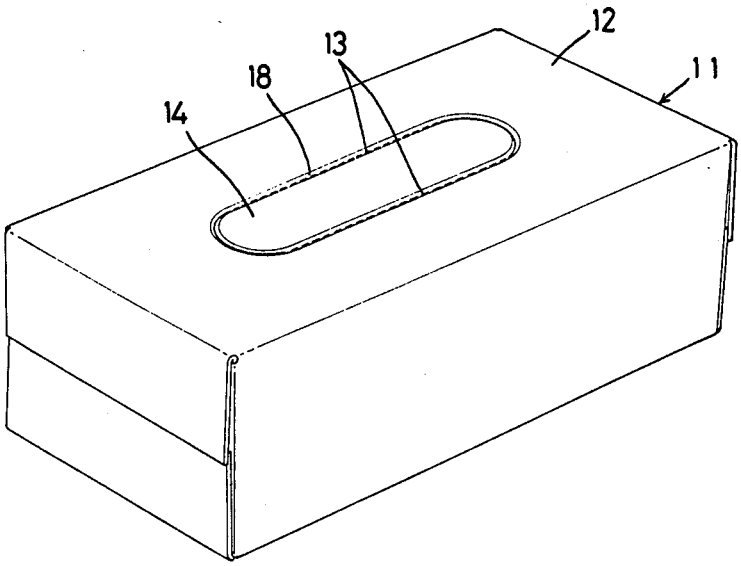
FIG. 1 is a perspective view showing the outer configuration of a case embodying the invention.
Figure 2:
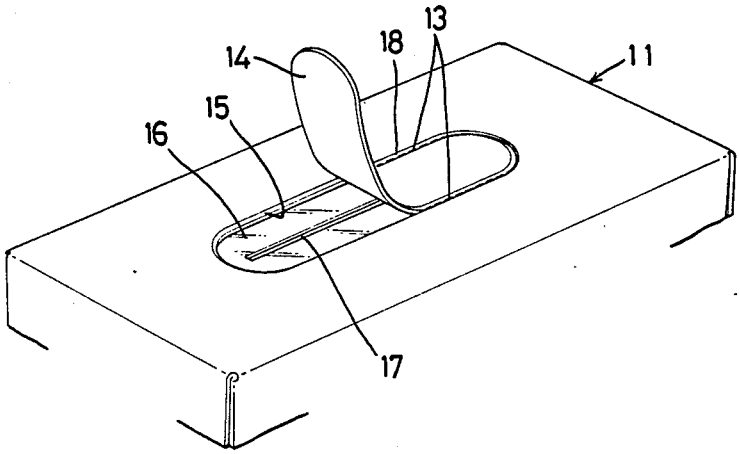
FIG. 2 is a perspective view showing the case as it appears when an opening is being formed.

As FIGS. 1 and 2 show, a boxboard-made case 11 for housing tissues therein is in the shape of a rectangular box and has an annular line of perforations 13 provided centrally on a top wall 12 thereof so that an opening 15 is formed when a cover plate portion 14 surrounded by the perforations 13 is removed by tearing it off along the line of perforations 13.

The case 11 has a synthetic resin film 16 laid on the underside of the top wall 12, the film 16 being provided with a slit 17 for drawing out tissues thereform through the opening 15.

On the top wall 12 of the case 11 there is embossed a ruled line 18 extending along the line of perforations 13 in overlapping relation therewith.

The ruled line 18 may be provided by first embossing same on the top wall 12, the perforations 13 being then formed on the ruled line 18, or the perforations are formed first and thereafter the ruled line is provided thereon by embossing. Alternatively, both the perforations 13 and the ruled line 18 may be formed simultaneously.

Figure 3:
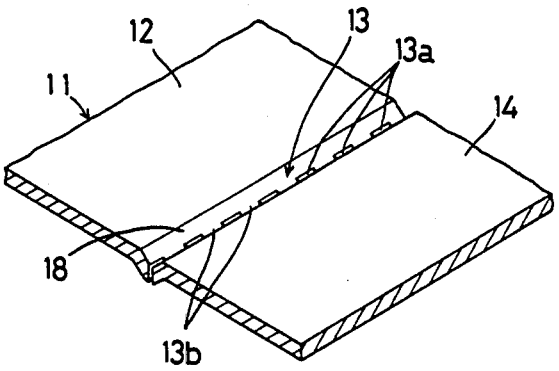
FIG. 3 is a fragmentary view of the top of the case in perspective showing a first form of perforations provided for formation of an opening.
Figure 4:
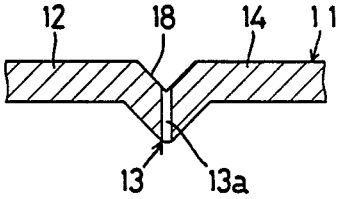
FIG. 4 is an enlarged longitudinal sectional view in front elevation showing the perforated portion in FIG. 3.

FIGS. 3 and 4 show a first form of ruled line 18, in which the ruled line 18 is embossed on the top wall at one side thereof in such a way that it is impressed into the outer surface of the case 11.

Figure 5:
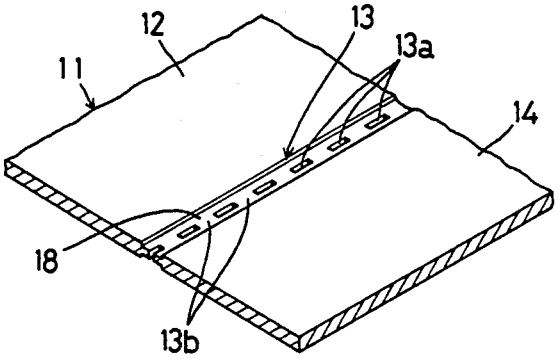
FIG. 5 is a fragmentary perspective view of the top of the case showing a second form of a perforated portion.
Figure 6:
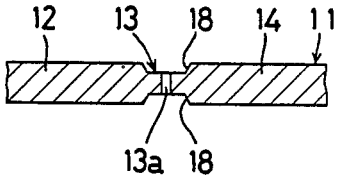
FIG. 6 is an enlarged longitudinal sectional view in front elevation showing the perforated portion in FIG. 5.

FIGS. 5 and 6 show a second form of ruled line 18, wherein ruled lines 18 are formed on both sides of the top wall 12.

The aforesaid line of perforations is such that short cutouts 13 are intermittently arranged. Therefore, non-cutout portions **13*b* are present between individual pairs of adjacent cutouts 13*a*, but as FIGS. 3 and 5 show, the ruled line 18 provided along the line of perforations 13 in overlaping relation therewith serves to break the body of the boxboard at non-cutout portions and concurrently to break the fiber structure of the boxboard through application of a force of compression, so that the strength of the non-cutout portions 13*a* is considerably lowered. Thus, when the perforations 13 are cut off, the ruled line 18 serves to guide the force of tearing from one cutout 13***a* to a next adjacent cutout 13*a*.

The configuration of the opening 15 defined by the perforations 13 is not limited to such an eliptic shape as shown in FIG. 1. Further, it is possible to provide a slit or notch continued to the line of perforations 13 at one end of the cover plate portion 14 so as to facilitate catching the end of the cover plate portion 14 with one's finger when forming the opening 15.

The case 11 is not limited to such a packaging case for facial tissues as shown, but it may be intended for any other suitable use, for example, a case having a line of perforations provided on a peripheral wall portion so that the content of the case can be drawn out by separating the case into two parts, upper and lower portions, by tearing off the perforated portion.

The case in accordance with the invention is of such construction as above described, and therefore, in order to form an opening for the purpose of drawing out the content of the case 11, the cover plate portion 14 surrounded by the perforations 13 is pulled with one's finger at one end thereof. The force of tearing which acts on the perforations 13 is accurately guided from one cutout to a next adjacent cutout, because the strength of the boxboard is reduced at non-cutout portions 36 between individual cutouts 13*a* than at other portions by virtue of the ruled line 18 provided in overlapping relation with the perforations 13.

Accordingly, the cover plate 14 can be accurately torn off by simply pulling it along the line of perforations 13 under the guidance of the ruled line 18. Thus the direction of the tearing does not deviate from the line of perforations 13. Problems of the cover plate 14 being torn off halfway or the trace of cutting extending outwardly of the opening are completely eliminated, so that the cover plate 14 can be readily removed to form an accurate opening 15.

What is claimed is:

1. A case having an annular line of perforations provided on a wall of the case so that an opening can be formed by removing a portion surrounded by the perforations by tearing it off along the line of perforations, comprising a ruled line provided along the line of perforations in overlapping relation therewith, the ruled line being formed by embossing in such manner that it is impressed on one side of the wall so that it projects on the other side of the wall.

2. A case having an annular line of perforations provided on a wall of the case so that an opening can be formed by removing a portion surrounded by the perforations by tearing it off along the line of perforations, comprising a ruled line provided along the line of perforations in overlapping relation therewith, the ruled line being formed by embossing on both sides of the wall in such manner that it is impressed into the wall on both sides thereof.

* * * * *